United States Patent [19]

Nakamura et al.

[11] Patent Number: 4,925,177

[45] Date of Patent: May 15, 1990

[54] AUTOMATIC PAPER FEEDER

[75] Inventors: Minoru Nakamura; Masazumi Ito, both of Osaka, Japan

[73] Assignee: Minolta Camera Kabushiki Kaisha, Osaka, Japan

[21] Appl. No.: 152,839

[22] Filed: Feb. 5, 1988

[30] Foreign Application Priority Data

Feb. 13, 1987 [JP] Japan ..... 62-30950

[51] Int. Cl.[5] ..... B65H 7/14; B65H 1/24

[52] U.S. Cl. ..... 271/110; 271/127; 271/225; 271/258

[58] Field of Search ..... 271/110, 111, 126, 127, 271/225, 256, 258, 259, 152, 153, 154–155, 22, 265, 902; 221/21; 453/35, 30, 32

[56] References Cited

U.S. PATENT DOCUMENTS

| | | | |
|---|---|---|---|
| 3,948,279 | 4/1976 | Gupta | 453/57 |
| 4,391,439 | 7/1983 | Edstrom | 271/263 |
| 4,394,088 | 7/1983 | Hanamoto et al. | 271/258 |
| 4,398,550 | 8/1983 | Shireman | 453/57 |
| 4,436,406 | 3/1984 | Murasaki et al. . | |
| 4,471,178 | 10/1984 | Furuichi et al. . | |
| 4,535,463 | 8/1985 | Ito et al. . | |
| 4,616,819 | 10/1986 | Makio et al. . | |
| 4,750,020 | 6/1988 | Ishizu et al. | 355/14 SH |

FOREIGN PATENT DOCUMENTS

| | | |
|---|---|---|
| 55-50264 | 4/1980 | Japan . |
| 57-78568 | 5/1982 | Japan . |
| 58-54435 | 12/1983 | Japan . |
| 59-217538 | 12/1984 | Japan . |

*Primary Examiner*—Joseph Rolla
*Assistant Examiner*—Steven Reiss
*Attorney, Agent, or Firm*—Burns, Doane, Swecker & Mathis

[57] ABSTRACT

An automatic paper feeder presses the surface of copying paper loaded on a paper loading plate in a paper cassette against a paper feeding roller, and feeds the paper sheet by sheet in accordance with the rotation of the roller. When a paper detector provided at a downstream side of the roller does not detect the paper within a specified period of time after starting a paper feeding operation, the automatic paper feeder rotates the roller in the reverse direction, at the same time releasing the pressure between the paper and the roller, and then increases the pressure and rotates the roller in the forward direction to restart the paper feeding operation.

8 Claims, 8 Drawing Sheets

AUTOMATIC PAPER FEEDER

BACKGROUND OF THE INVENTION

1. Field of the Invention

The present invention relates to an automatic paper feeder, and more specifically, to an automatic paper feeder which is attached to an image forming machine such as an electrophotographic copying machine, and which feeds copying paper, sheet by sheet, to the image forming portion of the image forming machine.

2. Description of Related Art

This type of an automatic paper feeder, in general has a construction to raise a paper loading plate in a paper cassette in order to press the upper surface of the copying paper loaded on the paper loading plate against a paper feeding roller, and to feed the copying paper, sheet by sheet, according to the rotation of the paper feeding roller. To detect any paper jammed at the paper feeding portion, these conventional paper feeders are provided with a combination of a sensor for detecting copying paper which is provided at the downstream side of the paper feeding roller, and a timer which is set to a specified period of time from the start of the paper feeding operation and to the detection of the paper by the sensor. When the sensor does not detect the paper within the period of time preset by the timer, it is always judged that paper jamming has occurred.

Defective paper feeding includes actual paper jamming which occurs after the front end of the paper has already been fed out of the paper cassette, and no-paper feeding condition which occurs when the fed paper remains in the paper cassette or when the paper, after having moved slightly, has stopped moving before its front end reaches the paper feeding roller because of the rotation slippage of the paper feeding roller. The above mentioned no-paper feeding condition occurs when the even pressure for pressing the upper surface of the paper against the paper feeding roller is not obtained, or when the specified pressure is not obtained due to a worn paper feeding roller. The former case is the main cause of no-paper feeding condition.

However, the conventional mechanism for detecting paper jamming determines that the above described no-paper feeding condition is a paper jamming, then stops the copying operation and displays a paper jamming alarm on the operation panel. Therefore, the operator must always check the automatic paper feeder for jammed paper before restarting the operation. This procedure is complicated and, at the same time, time-consuming.

SUMMARY OF THE INVENTION

Accordingly, the object of the present invention is to automatically correct the conventional no-paper feeding condition in order to release the operator from unnecessarily checking the automatic paper feeder for jammed paper.

To realize the above object, an automatic paper feeder according to the present invention feeds copying paper sheet by sheet from a paper cassette in accordance with the rotation of a paper feeding roller, and comprises a paper loading plate in the cassette, the paper feeding roller disposed above the paper loading plate, means for raising and lowering the paper loading plate, means for detecting the paper, provided at a downstream side of the roller, and controlling means for lowering the paper loading plate in order to release the pressure between the upper surface of the paper and the roller when the paper detecting means does not detect the paper within a specified period of time after starting a paper feeding operation, and then the same controlling means for raising the paper loading plate in order to press the upper surface of the paper against the roller to restart the paper feeding operation.

Further, an automatic paper feeder according to the present invention feeds copying paper sheet by sheet from a paper cassette in accordance with the rotation of a paper feeding roller, and comprises said paper feeding roller, driving means for rotating the roller in the forward and reverse directions, said paper detecting means, and controlling means for rotating the roller in the reverse direction when the paper detecting means does not detect the paper within a specified period of time after starting a paper feeding operation, and then the same controlling means for rotating the roller in the forward direction to restart the paper feeding operation.

Further, an automatic paper feeder according to the present invention feeds copying paper sheet by sheet from a paper cassette in accordance with the rotation of a paper feeding roller, and comprises said paper feeding roller, said paper loading plate, said driving means, said raising/lowering means, said paper detecting means and controlling means for rotating the roller in the reverse directions, at the same time lowering the paper loading plate in order to release the pressure between the upper surface of the paper and the roller when the paper detecting means does not detect the paper within a specified period of time after starting a paper feeding operation, and then the same controlling means for raising the paper loading plate in order to press the upper surface of the paper against the roller to restart the paper feeding operation.

Further, an automatic paper feeder according to the present invention feeds copying paper sheet by sheet from a paper cassette in accordance with the rotation of a paper feeding roller, and comprises said paper feeding roller, means for altering the pressure between the upper surface of the paper and the roller, said paper detecting means, and controlling means for increasing the pressure to restart a paper feeding operation when the paper detecting means does not detect the paper within a specified period of time after starting the paper feeding operation.

At the above-mentioned constitution, when the paper detecting means does not detect the paper within a specified period of time (for example, by the starting timing of the forward rotation of the paper feeding roller) after having started the paper feeding operation, it is judged that a no-paper feeding condition has occurred, whereupon the paper feeding roller is rotated in the reverse direction momentarily, or the paper loading plate is lowered, or both operations are conducted. Even if the paper has stopped moving prior to reaching the paper feeding roller, the operation(s) return(s) the paper onto the paper loading plate and also releases the pressure between the upper surface of the paper and the paper feeding roller. Next, the paper loading plate is raised, etc. so that the upper surface of the paper is pressed against the paper feeding roller to restart the paper feeding operation. By means of the above mentioned procedure, the upper surface of the paper is pressed against the paper feeding roller again and the paper feeding operation is automatically restarted.

Therefore, the copying operation continues without inconveniencing the operator.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
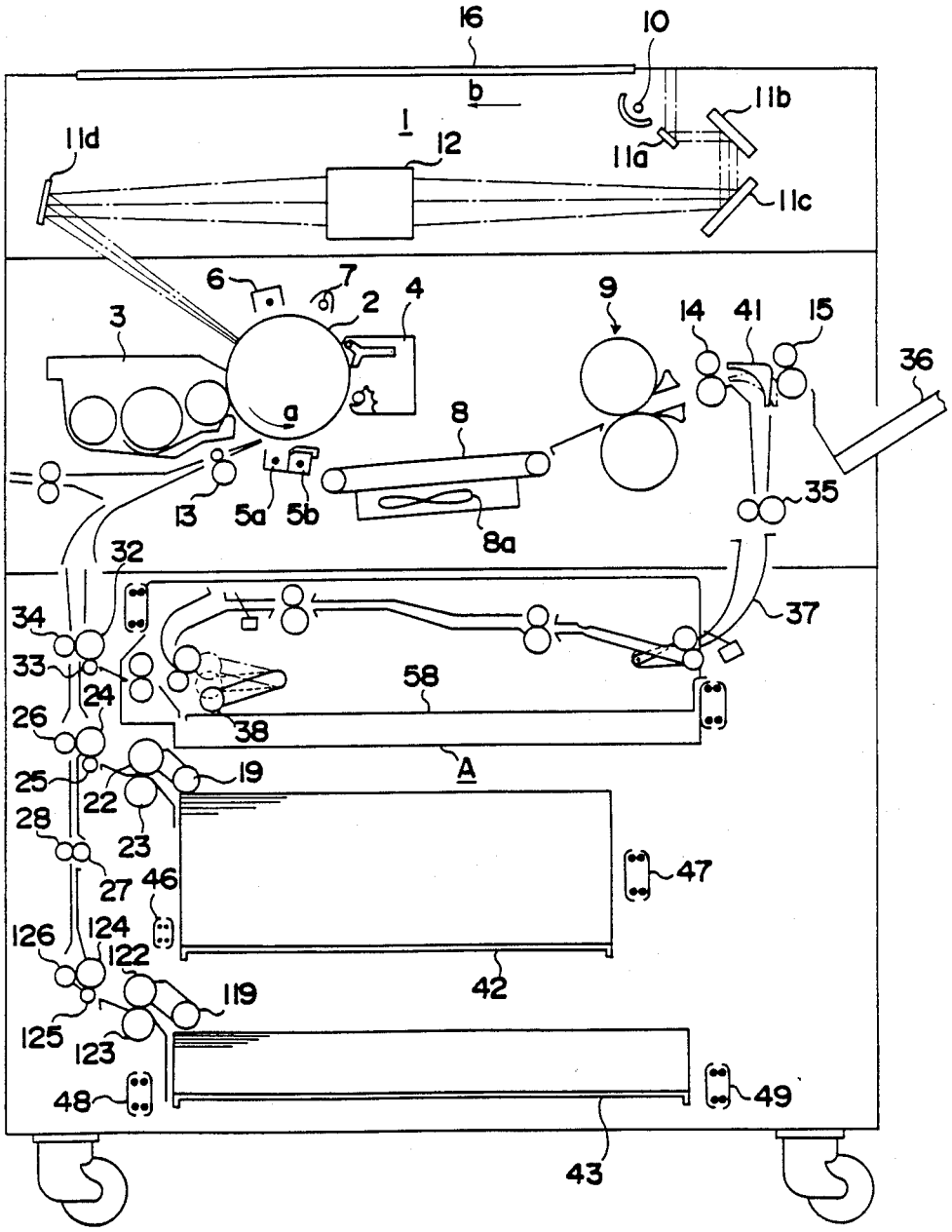
FIG. 1 is a general view of a copying machine including an automatic paper feeder according to the invention.

General constitution of copying machine (refer to FIG. 1)

First, the general constitution of a copying machine will be explained together with a copying operation.

This copying machine comprises paper feeders 42 and 43 which are loaded on the lower step, an intermediate tray unit A which is located right above the paper feeders, an image forming unit which mainly consists of a photosensitive drum 2 and is located on the middle step, and an optical system 1 which is located on the upper step. The copying machine enables duplex copies and composite copies to be made by transporting paper having one copied side onto the intermediate tray unit A and then re-feeding the paper to the image forming unit again.

The photosensitive drum 2 can rotate in the direction shown by an arrow a. Around the photosensitive drum 2, and in order of sequence, an electrifying charger 6, a magnetic brush-type developing unit 3, a transfer charger 5*a*, a separation charger 5*b*, a blade-type cleaning unit 4, and an eraser lamp 7 are provided. The photosensitive drum 2 is uniformly charged by the electrifying charger 6 while the drum 2 is rotating in the direction shown by the arrow a, and is exposed to an image through the optical system 1 to form an electrostatic latent image on the drum 2. The electrostatic latent image is developed into a toner image by the developing unit 3.

The optical system 1 can scan an image from under a document deck glass 16 in the direction shown by an arrow b. The optical system 1 consists of a light source 10, moving mirrors 11*a*, 11*b*, and 11*c*, an image projecting lens 12, and a fixed mirror 11*d*. The light source 10 and the moving mirror 11*a* move as one unit in the direction shown by the arrow b at a velocity of V/m (V: peripheral speed of the photosensitive drum 2 which is constant regardless of the copying magnification; m: copying magnification). The moving mirrors 11*b* and 11*c* move as one unit in the direction shown by the arrow b at a velocity of V/2m.

The paper feeders 42 and 43 can be pulled out from the front side by sliding them on rails 46 and 47 and on rails 48 and 49, respectively. Copying paper in a paper feeder selected from the upper paper feeder 42 and the lower paper feeder 43 is fed by paper feeding rollers 19 and 119, handled by paper manipulation rollers 22, 23 and 122, 123 sheet by sheet, and transported to a pair of timing roller 13 by transporting rollers 24, 25, 26 and 32, 34, and 124, 125, 126 and 27, 28. The copying paper, after being stopped by the pair of timing roller 13, is fed to the copying portion so as to synchronize the timing of the paper feeding with that of the image formed on the photosensitive drum 2. Then, a toner image is transferred onto the paper by the electric discharge of the transfer charger 5*a*, while simultaneously, the paper is separated from the photosensitive drum 2 by the electric discharge of the separation charger 5*b*, and then transported into a fixing unit 9 by a conveyor belt 8 equipped with an air suction unit 8*a*, where the toner is fused and the image is fixed.

Between a pair of transporting rollers 14 located in an adjacent position to the outlet of the fixing unit 9, and a pair of ejection rollers 15, a lever 41 for switching the paper passage are provided. To eject paper from this position, the lever 41 is set in the manner shown by the dashed line in FIG. 1 and the paper transported from the fixing unit 9 is ejected through the pair of ejection rollers 15 onto a tray 36. To perform a duplex copy or composite copy, the lever 41 is set in the manner shown by the continuous line and the paper is transported by a pair of transporting rollers 35 via a guide plate 37 into the intermediate tray unit A. The paper transported into the tray unit A is stored on an intermediate tray 58 and re-fed by the rotation of a paper re-feeding roller 38 for duplex or composite copying operation. However, a detailed description of the paper re-feeding procedure is omitted in this specification.

After an image is transferred from the photosensitive drum 2, the residual toner is removed by the cleaning unit 4, and the residual charge is removed by the illumination from the eraser lamp 7. By this operation, the drum 2 is prepared for the next copying operation.

Figure 2:
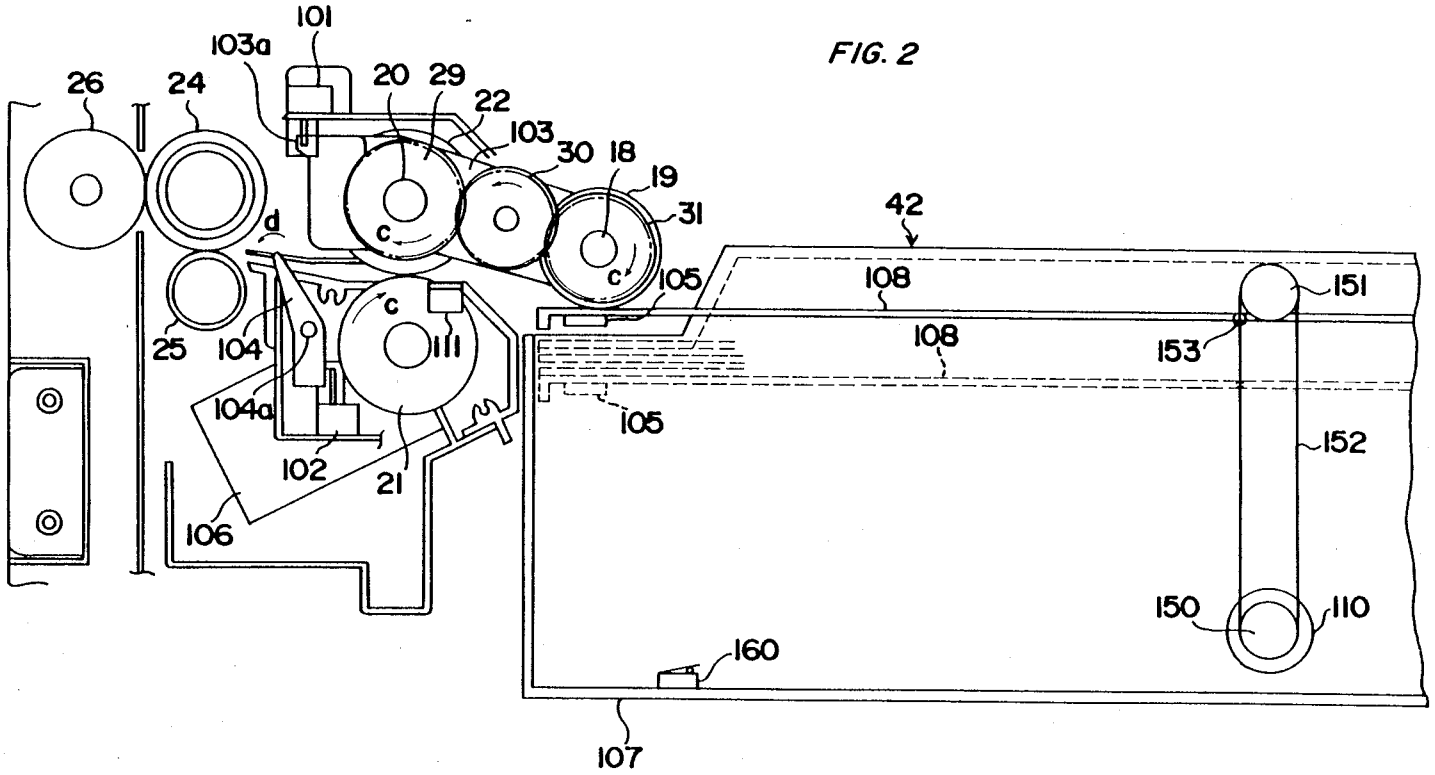
FIGS. 2 and 3 are front views of the automatic paper feeder.
Figure 3:
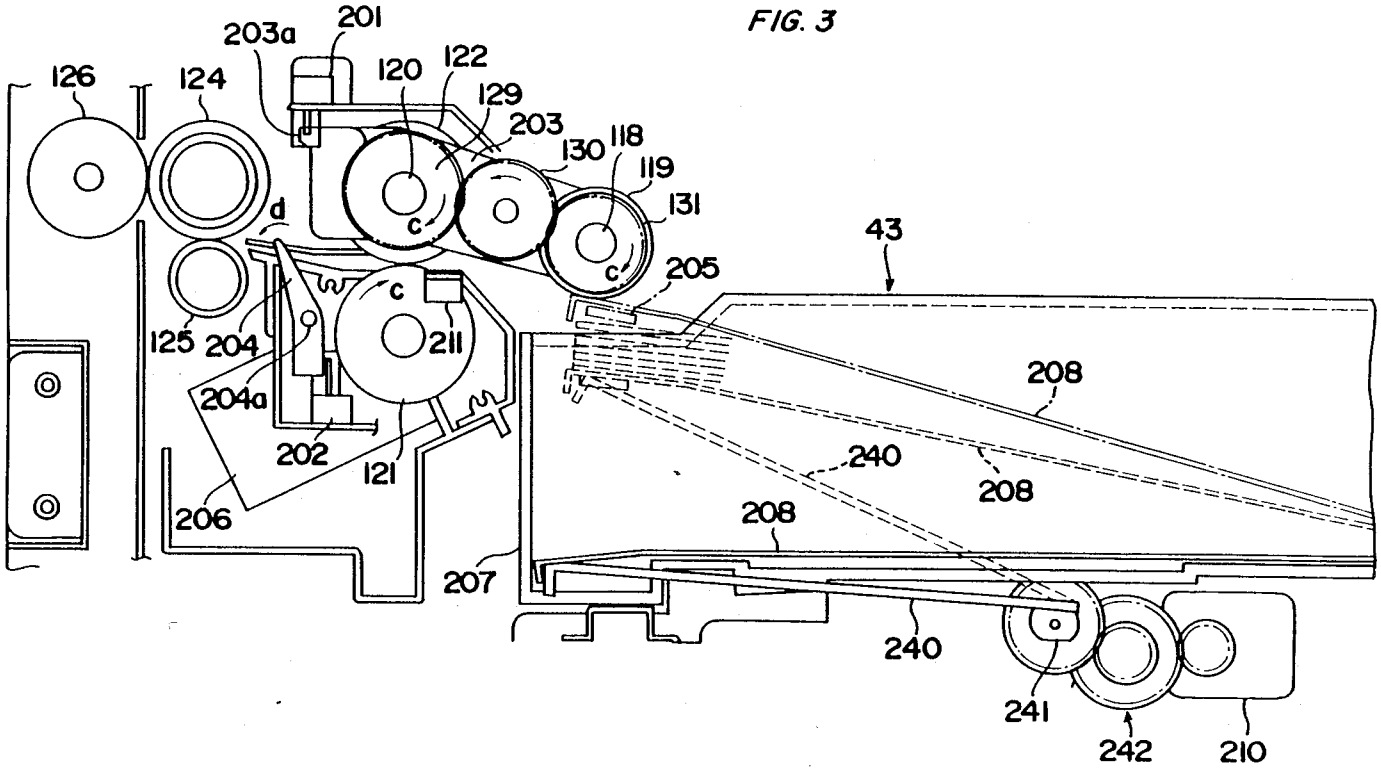

Paper feeder (refer to FIGS. 2 and 3)

The upper paper feeder 42 adopts an elevator method. The paper loading plate 108 can rise and lower in a paper cassette 107, maintaining a horizontal position, and is secured, by a metal fitting 153, to a chain 152 engaged on longitudinally located sprockets 150 and 151. The sprocket 150 is linked with an elevation motor 110 via a reduction gear mechanism which is not shown in FIG. 2.

The lower paper feeder 43 adopts a lift-up method. The paper loading plate 208 can pivot in both the rising and lowering directions around its rear portion which is not shown in FIG. 3, and rises and lowers, interlocking with the motion of a pressing plate 240. The bearing shaft 241 of the pressing plate 240 is linked, via a reduction gear mechanism 242, to an elevation motor 210 which can rotate in both the forward and reverse directions.

Each paper feeding rollers 19 and 119 are mounted on frames 103 and 203, which can rotate freely around bearing shafts 20 and 120 of the manipulation rollers 22 and 122. Therefore, when the above-mentioned elevation motors 110 and 210 are turned on for the rotation in the forward direction, the paper loading plates 108 and 208 rise, pressing the upper surface of the paper loaded thereon against the paper feeding rollers 19 and 119 and thereby slightly raising the paper feeding rollers 19 and 119. The upper limit position of the copying paper is detected by sensors 101 and 201. In other words, when the paper loading plates 108 and 208 rise until the paper feeding rollers 19 and 119 are pressed upward by the upper surface of the paper to a specified height, protruding portions 103*a* and 203*a* of the frames 103 and 203 which are located on the optical axis of the sensors 101 and 201 release the optical axis and the sensors 101 and 201 are turned on. The forward rotation of the elevation motors 110 and 210 are turned off according to the on-signals from the sensors 101 and 201. When the paper feeding operation continues and the height of the upper surface of the paper lower, the paper feeding rollers 19 and 119 slightly lower and the protruding portions 103*a* and 203*a* intercept the optical axis and the sensors 101 and 201 are turned off. The forward rotation of the elevation motors 110 and 210 are turned on according to the off-signals from the sensors 101 and 201, and the paper loading plates 108 and 208 are raised. The on- and off-signals raise the paper loading plates 108 and 208 step by step to maintain the height of the upper surface of the paper (paper feeding height) at a constant, and at the same time, to maintain the pressure (paper feeding pressure), which presses the upper surface of the paper against the paper feeding rollers 19 and 119, at a constant.

At the tips of the lower surface of each paper loading plates 108 and 208, sensors 105 and 205 are provided to detect whether copying paper is located on the loading plates 108 and 208. The elevation motors 110 and 210 are turned on for the rotation in the forward direction only when the sensors 105 and 205 detect the existence of paper. When the sensors 105 and 205 detect there is no paper on the paper loading plates 108 and 208, the elevation motors 110 and 210 are turned on for the rotation in the reverse direction and the paper loading plates 108 and 208 lowers. A switch 160, which is provided on the bottom of the upper paper cassette 107, detects the limit of lowering of the paper loading plate 108.

The paper feeding rollers 19 and 119 and the manipulation rollers 21, 22 and 121, 122 for each of the paper feeders 42 and 43 are rotated by paper feeding motors 106 and 206 which can rotate in the forward and reverse directions. The paper feeding motors 106 and 206 are linked to the manipulation rollers 21, 22 and 121, 122 via a reduction gear which is not shown in the figures. Gears 31 and 131, which are secured to the bearing shafts 18 and 118 of the paper feeding rollers 19 and 119 are engaged with gears 29 and 129 which are secured to the bearing shafts 20 and 120 of the manipulation rollers 22 and 122 via idle gears 30 and 130. Therefore, when the paper feeding motors 106 and 206 are turned on for the rotation in the forward direction, the paper feeding rollers 19 and 119 and the manipulation rollers 21, 22 and 121, 122 are rotatively driven in the direction shown by an arrow c and the topmost paper is fed from the paper cassettes 107 and 207. The fed paper passes between the manipulation rollers 21, 22 and 121, 122, is guided by the transporting rollers 24, 25, 26 and 124, 125, 126, and is transported to the above-mentioned image forming unit.

With regard to the paper feeding passages, sensors 102 and 202 for detecting the paper between the manipulation rollers 21, 22 and 121, 122 and the transporting rollers 24, 25 and 124, 125, and sensors 111 and 211 for detecting the paper immediately before the grip portions of the manipulation rollers 21, 22 and 121, 122 are provided. The sensors 102 and 202 are equipped with actuators 104 and 204 which can rotate freely around pins 104*a* and 204*a*. The front portion of the actuators 104 and 204 are positioned in the paper feeding passages, and its lower end are so positioned as to be able to intercept and release the optical axis of the sensors 102 and 202.

Therefore, first, the fed paper is detected directly by the sensors 111 and 211. Then, the paper rotates the actuators 104 and 204 in the direction shown by an arrow d, and the lower end of the actuators 104 and 204 intercept the optical axis of the sensors 102 and 202 whereby the paper is then detected by the sensors 102 and 202. Each of the sensors 111, 102, 211 and 202 is turned on when the front end of the paper passes through the optical axis, and is turned off when the rear end of the paper passes through it.

Function of sensors 102, 202, 111 and 211 (refer to FIGS. 2 and 3)

The sensors 102 and 202 functions:

(1) for controlling the continuous feeding of paper; and (2) for detecting whether paper has jammed.

The sensors 111 and 211 functions:

(3) for detecting a no-paper feeding condition.

(1) Continuous paper feeding

When the paper feeding rollers 19 and 119 are rotated in the direction shown by the arrow c via means of the paper feeding motors 106 and 206, the topmost paper is fed, and as a result, turns on the sensors 102 and 202 via the actuators 104 and 204. The paper is then enclosed between the transporting rollers 24, 25, 26 and 124, 125, 126 in order to be transported through the passages. When the front end of the paper, which is detected by the sensors 102 and 202, has reached the transporting rollers 24, 25 and 124, 125, and the rollers have applied the transporting force on the paper, the forward rotation of the paper feeding motors 106 and 206 are stopped. Then, the paper is transported by the transporting force applied by the transporting rollers 24, 25, 26 and 124, 125, 126. The rear end of the paper then passes by the actuators 104 and 204, turning off the sensors 102 and 202. When a specified period of time has elapsed after the sensors 102 and 202 are turned off, the timer starts operation and the paper feeding motors 106 and 206 are turned on for the rotation in the forward direction. The next sheet of paper is thereupon fed. The above operation is repeated until the preset number of sheets have been fed.

(2) Detection of paper jamming

When the paper to be fed by the rotation of the paper feeding rollers 19 and 119 do not turn on the sensors 102 and 202 within a specified period of time, it is judged that paper jamming has occurred. The timer provided for this function is set at the time obtained by adding some extra time to the required transport time from the turning-on of the forward rotation of the paper feeding motors 106 and 206 to the detection of the front end of the paper by the sensors 102 and 202.

When paper jamming has been determined to have occurred, the forward rotation of the paper feeding motors 106 and 206 are stopped, and the copying machine then executes the alarming processing function, etc.

(3) Detection of no-paper feeding condition

When the paper to be fed by the rotation of the paper feeding rollers 19 and 119 do not turn on the sensors 111 and 211 within a specified period of time, it is judged that the no-paper feeding condition has occurred due to rotational slippage of the paper feeding rollers 19 and 119, etc. The timer provided for this function is set at the time obtained by adding some extra time to the required transport time from the turning-on of the forward rotation of the paper feeding motors 106 and 206 to the detection of the front end of paper by the sensors 111 and 211 in the same manner as above (2).

When the no-paper feeding condition has been determined to have occurred, the paper feeding rollers 19 and 119 are rotated in the reverse direction for a specified period of time and at the same time, the elevation motors 110 and 210 are also rotated in the reverse direction for a specified period of time to lower the paper loading plates 108 and 208. The paper loading plates 108 and 208 shown in FIGS. 2 and 3 by the dotted line shows this condition. By means of the above operation, and pressure applied for pressing the upper surface of the paper against the paper feeding rollers 19 and 119 are released. In this operation, a force in the opposite direction is applied onto the paper by the reverse rotation of the paper feeding rollers 19 and 119, and paper which has moved slightly and then stopped moving before reaching the paper feeding rollers 19 and 119 is returned onto the paper loading plates 108 and 208. At the rear portion of the paper loading plates 108 and 208, rear portion limit plates, which are not shown in the attached drawings are provided to prevent the returned paper from exceeding the specified limit.

Next, the elevation motors 110 and 210 are rotated in the forward direction to raise the paper loading plates 108 and 208. By means of this operation, the upper surface of the paper is pressed against the paper feeding rollers 19 and 119 thereby restoring the forcible contact condition of the paper and the paper feeding rollers 19 and 119. In this operation, the raising distance is set at a slightly larger value than the above-mentioned lowering distance. In other words, the time for the forward rotation of the elevation motors 110 and 210 are set at a slightly longer time than for the reverse rotation. Therefore, the restored pressure for pressing the upper surface of the paper against the paper feeding rollers 19 and 119 (paper feeding pressure) is slightly more than the pressure applied when the no-paper feeding condition occurs. In other words, the no-paper feeding condition is caused when the paper feeding pressure is reduced by slightly more than the standard value because of the dispersed detection position of the upper limit position detecting sensors 101 and 201 which detect the upper limit position of the paper, or because of the dispersed timing for stopping the forward rotation of the elevator motors 110 and 210 when raising the paper to its upper limit position. Therefore, in this embodiment, after the no-paper feeding condition has been detected, the paper feeding pressure is re-set to a slightly higher value than the previous value.

After that, the paper feeding motors 106 and 206 are turned on for the forward rotation to restart the paper feeding operation.

In this embodiment, if the no-paper feeding condition occurs when the succeeding sheet of paper is fed after the above operation, the same processing procedure as that for correction of paper jamming is conducted. In other words, an alarm indicating that paper has jammed is displayed on a fluorescent charactor display tube 302 shown in FIG. 4 and the copying operation is stopped.

Figure 4:
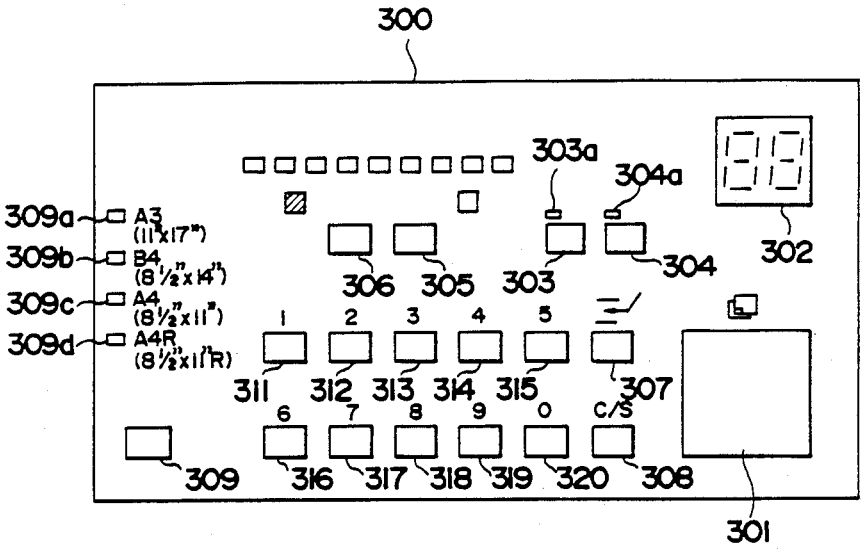
FIG. 4 is a plan view of an operation panel disposed on the copying machine.

Operation panel (refer to FIG. 4)

Next, the arrangement of each operation key on an operation panel 300 of the copying machine is explained by referring to FIG. 4.

The operation panel 300 has a print key 301 for starting the copying operation, the fluorescent charactor display tube 302 which can display a 2-digit numeral, ten keys 311 through 320 which correspond to integers from 0 to 9 respectively, an interruption key 307 for specifying the interrupting copying operation, a clear/-stop key 308, a copying paper size selection key 309 for selecting the paper to be fed by specifying the paper size from among the paper stored in the paper feeders 42 and 43, up and down keys 305 and 306 for altering and specifying the image density step by step, a duplex copy selection key 303, and a composite copy selection key 304.

Figure 5B:
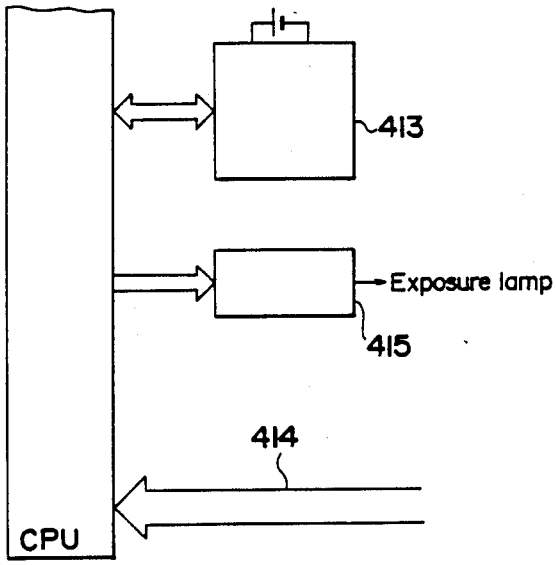
FIGS. 5A and 5B are block diagrams of a control circuit.
Figure 5A:
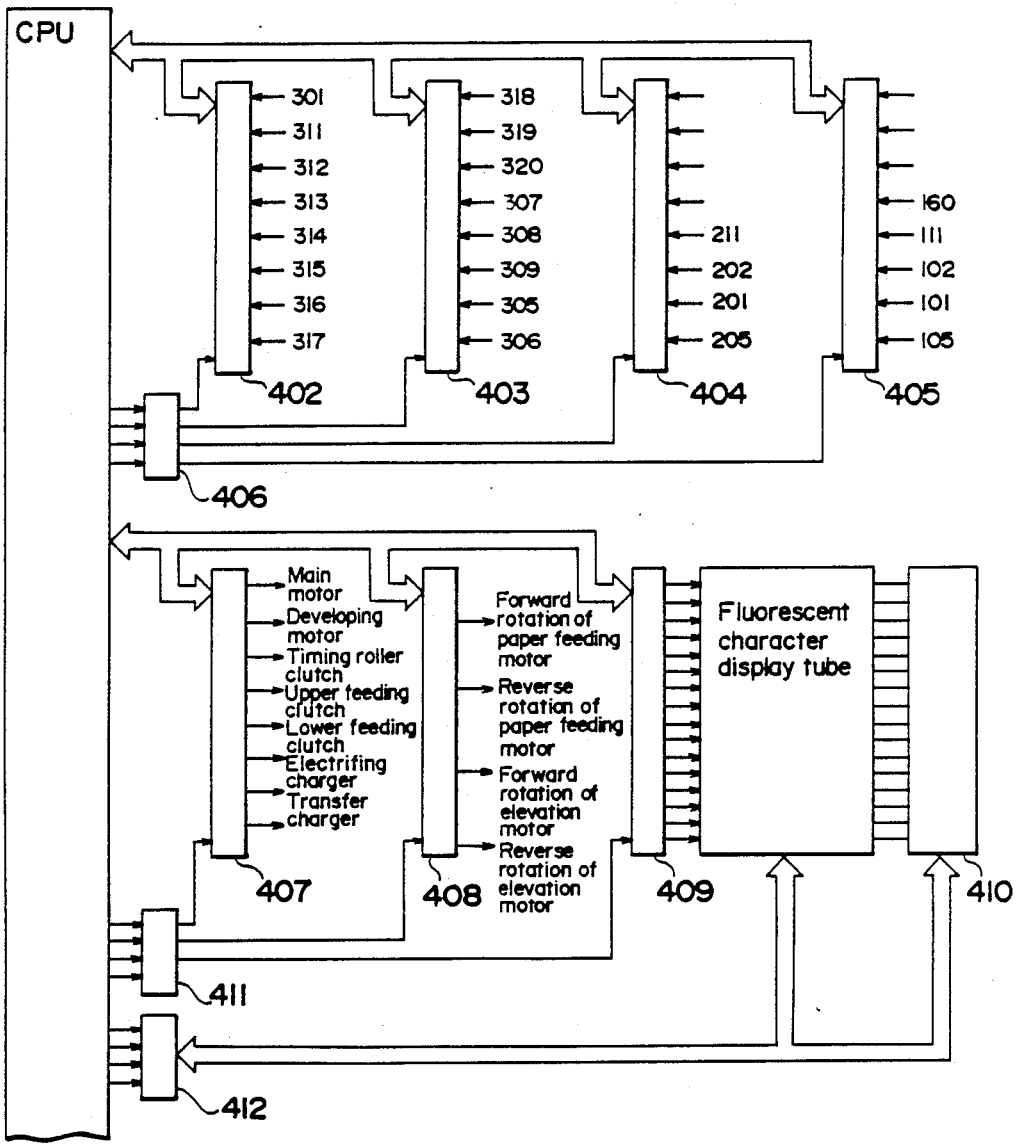

Switches which correspond to these operation keys, and each of the sensors provided on the copying machine, and the paper feeders 42 and 43 are connected to a control circuit including a microcomputer system shown in FIGS. 5A and 5B.

Control circuit (refer to FIGS. 5A and 5B)

FIGS. 5A and 5B show the input/output configuration of a microprocessor which controls the copying machine (hereinafter referred to as the CPU). Numerals 402 through 405 show the integrated circuits for extending the input, which are connected to the CPU by a data line and to a control port via a decoder 406. The on- and off-signals of the above sensors 101, 102, 105, 201, 202, 205 and 211 are entered to an input terminal of the integrated circuit 405 for extending the input. Numerals 407 through 409 show the integrated circuits for extending the output, which are connected to the CPU by a data line and to a control port via a decoder 411. To an output terminal of the integrated circuit 409 for extending the output, a fluorescent character display tube 302 and an LED matrix 410 are connected, and also, they are connected to the CPU via a decoder 412.

Moreover, the CPU is connected to a random access memory 413 which is backed-up by a battery and an exposure adjusting circuit 415 of the exposure light source 10. The CPU transfers, to the exposure adjusting circuit 415, the value selected from the 9 steps of exposure degree when the manual exposure selection is adopted, and transfers the central value when the automatic exposure selection is adopted.

A bus 414 is a communication line by which the CPU is connected to other microprocessors which control the optical system 1, etc.

Figure 6:
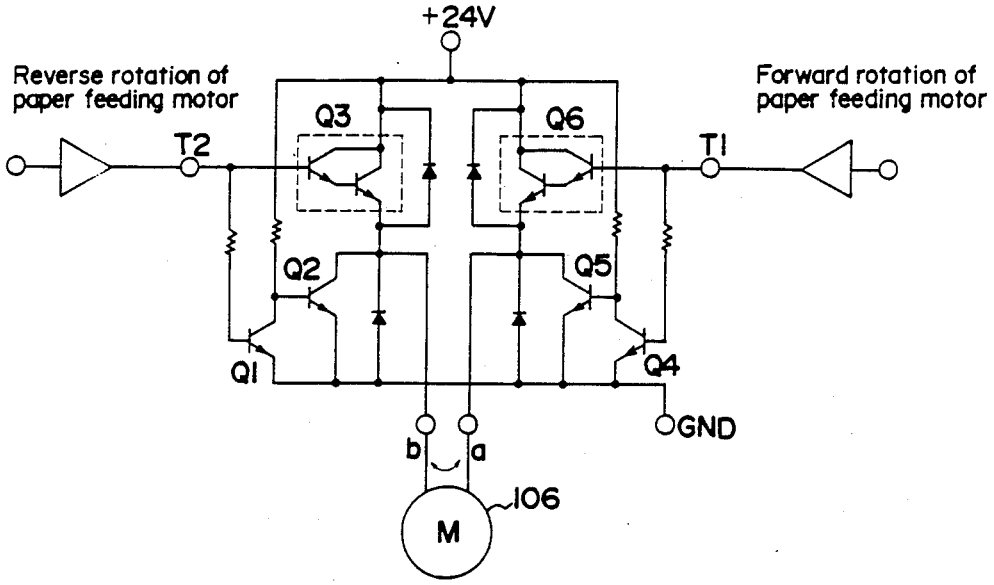
FIGS. 6 and 7 are driving circuit diagrams of the motor.
Figure 7:
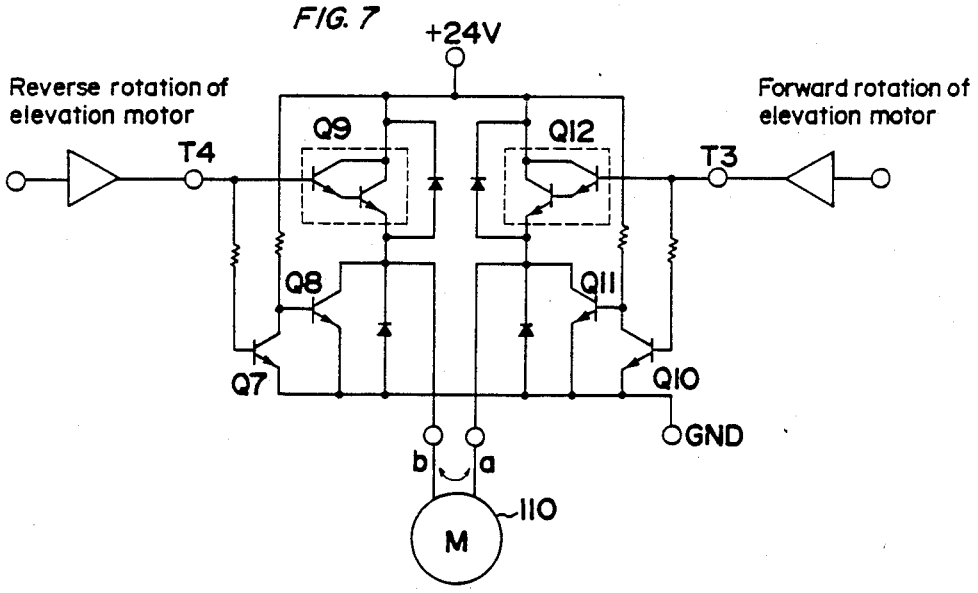

Motor-drive circuit (refer to FIGS. 6 and 7)

FIG. 6 and FIG. 7 show a drive circuit of the paper feeding motor 106 and a drive circuit of the elevation motor 110 respectively. Although the following is intended to describe the function of the upper paper feeding unit, the description is also applicable to the lower paper feeding unit.

Both circuits consist of transistors Q2, Q3, Q5, Q6, Q8, Q9, Q11, and Q12 which are connected by bridge connections. When the forward rotation signal is entered to terminals T1 and T3, the transistors Q4, Q6, and Q10, Q12 are turned on and the current flows in the direction shown by an arrow a to rotate the motors 106 and 110 in the forward direction. On the other hand, when the reverse rotation signal is entered to terminals T2 and T4, the transistors Q1, Q3, and Q7, Q9 are turned on and the current flows in the direction shown by an arrow b to rotate the motors 106 and 110 in the reverse direction.

Tables 1 and 2 below show the relationship between the control signals (forward rotation/reverse rotation) and the on- and off-condition of each transistor, and the operation of the sensors 106 and 110 according to the signal and the condition of each transistor.

TABLE (1)

| Operation for feeding motor | | | | | | |
|---|---|---|---|---|---|---|
| control signals | | condition of transistors | | | | |
| forward | reverse | Q2 | Q3 | Q5 | Q6 | operation |
| 0 | 0 | ON | OFF | ON | OFF | brake |
| 0 | 1 | OFF | ON | ON | OFF | reverse |
| 1 | 0 | ON | OFF | OFF | ON | forward |
| 1 | 1 | ON | OFF | ON | OFF | stop |

TABLE (2)

| control signals | | condition of transistors | | | | |
|---|---|---|---|---|---|---|
| raise | lower | Q8 | Q9 | Q11 | Q12 | operation |
| 0 | 0 | ON | OFF | ON | OFF | brake |
| 0 | 1 | OFF | ON | ON | OFF | reverse |
| 1 | 0 | ON | OFF | OFF | ON | forward |
| 1 | 1 | ON | OFF | ON | OFF | stop |

Figure 8A:
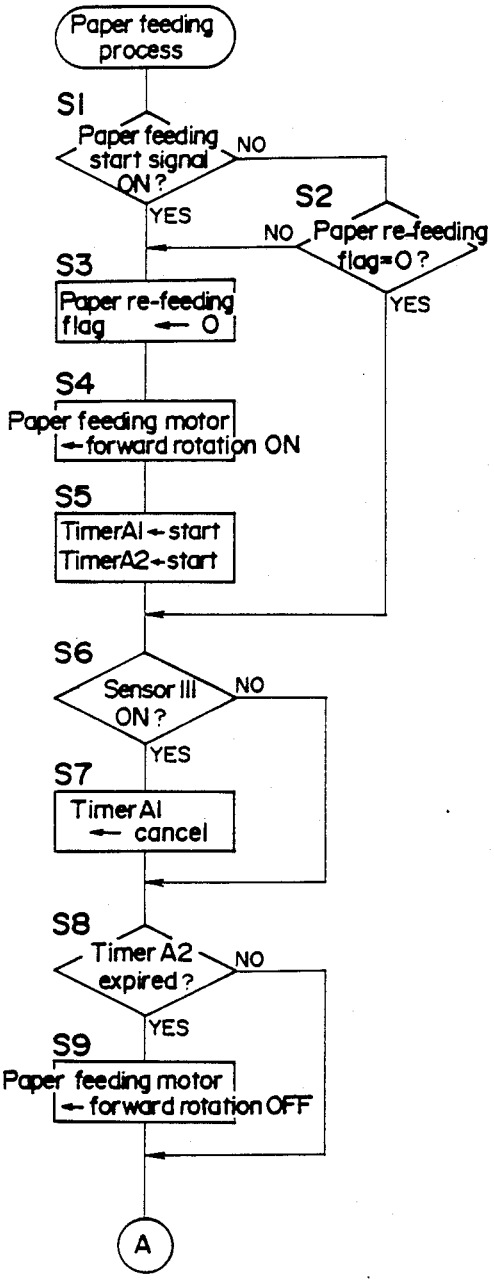
FIGS. 8A and 8B are flow charts which show controlling procedure.
Figure 8B:
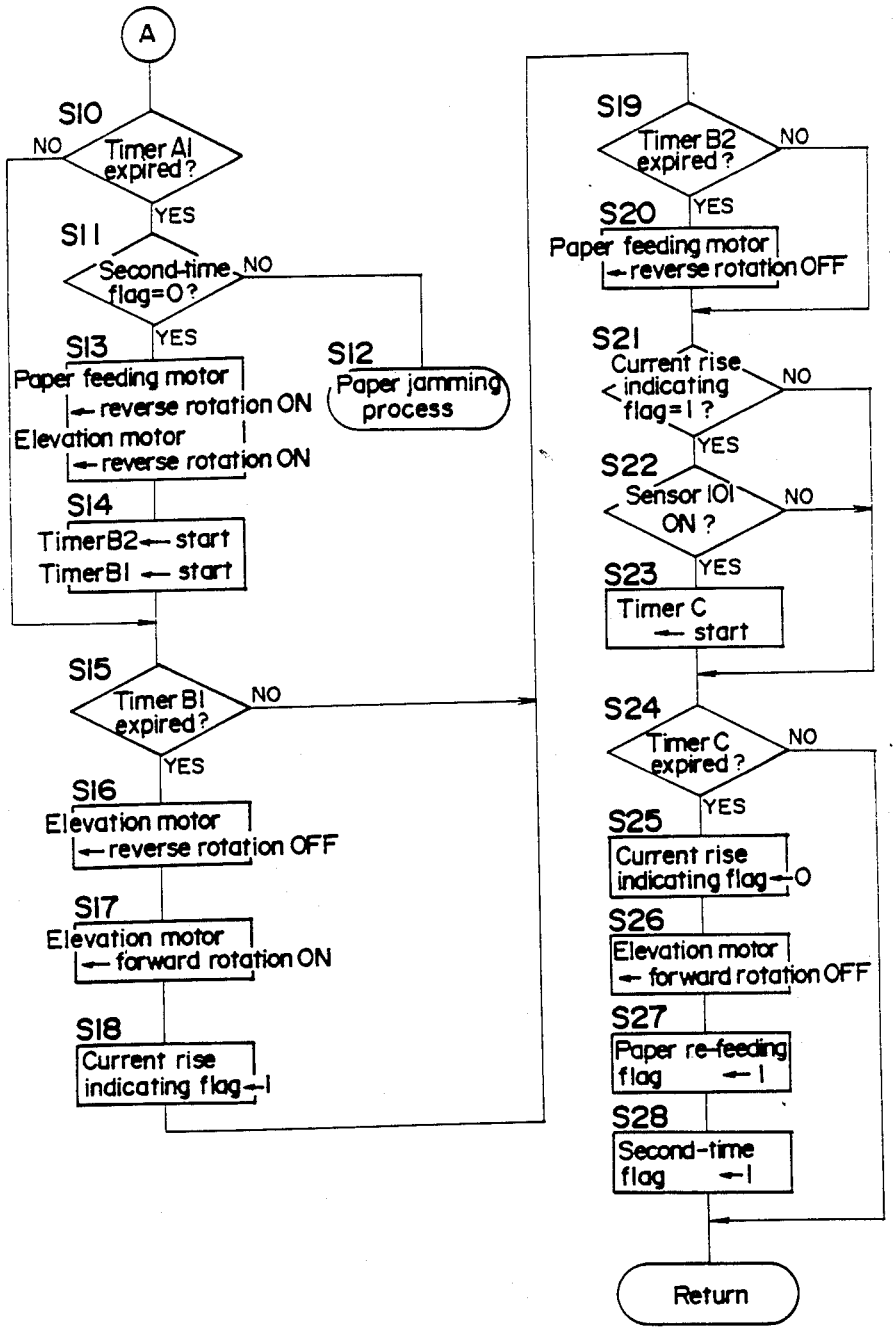

Controlling procedure (refer to FIGS. 8A and 8B)

Among the controlling processes which are executed in the CPU, FIGS. 8A and 8B show the subroutine for the paper feeding processing according to the present invention. Although the following is intended to describe the controlling procedure of the upper paper feeding unit, the description is also applicable to the lower paper feeding unit.

When this subroutine is called, it is judged at step S1 whether the signal for starting the feeding of paper is turned on. When it is judged YES, the program proceeds to step S3. When it is judged NO, it is determined at step S2 whether the paper re-feeding flag is "0". The paper refeeding flag is for requesting the feeding of the succeeding sheet of paper (paper re-feeding or second-time feeding) after correcting the no-paper feeding condition, and is set to "1" after correcting the no-paper feeding condition (step S27). When it is judged NO at step S2, in other words, when the paper re-feeding condition is requested, the program proceeds to step S3.

Next, at step S3, the paper re-feeding flag is reset to "0". Then at step S4, the paper feeding motor 106 is turned on for the forward rotation and, at the same time, at step S5, timers A1 and A2 are actuated. By the above operation, the paper feeding roller 19 is rotated in the direction shown by the arrow c and the topmost paper is fed. In this operation, the timer A1 is used to detect the no-paper feeding condition, and is set at the time obtained by adding extra time to the time required from the paper feeding to the detection of the front end of the paper by the no-paper feeding detection sensor 111. The timer A2 is used to stop the forward rotation of the paper feeding motor 106, and is set at the time obtained by adding extra time to the time required until the transport force is applied onto the fed paper by the transporting rollers 24, 25, and 26.

Next, at step S6, it is judged whether the sensor 111 is turned on, in other words, whether the front end of the fed paper has reached the sensor 111. If it is judged YES, the setting of the timer A1 is canceled at step S7. Next, when it is detected, at step S8, that the set time of the timer A2 has expired, the forward rotation of the paper feeding motor 106 is turned off at step S9.

Next, at step S10, it is judged whether the set time of the timer A1 has expired. If it has expired, it is judged that the paper has not reached the sensor 111 within the specified period of time and that the no-paper feeding condition has occurred. It is then judged at step S11 whether the second-time flag is set at "0". The second-time flag is to indicate the current paper feeding is the second paper feeding executed after correcting the no-paper feeding condition and is set to "1" after correcting the no-paper feeding condition (step S28). Therefore, when the secondtime flag remains reset to "0", the current no-paper feeding condition is judged the first no-paper feeding condition and, at step S13, the paper feeding motor 106 is turned on for the reverse rotation and the elevation motor 110 is turned on for the reverse rotation. At the same time, at step S14, timers B2 and B1 are actuated. By this operation, the paper feeding roller 19 is turned on for the reverse rotation and the paper loading plate 108 also starts lowering to release the pressure which presses the upper surface of the paper against the paper feeding roller 19. In this operation, the timer B1 is used to determine the lowering distance of the paper loading plate 108 and to switch the motion to rising; the timer B2 is used to turn off the reverse rotation of the paper feeding motor 106.

Next, when at step S15 it is judged that the set time of the timer B1 has expired, at step S16, the reverse rotation of the elevation motor 110 is turned off, at step S17, the forward rotation of the elevation motor 110 is turned on, and at step S18, the current rise indicating flag is set to "1". By this operation, the paper loading plate 108 is started to rising. Next, when at step S19 it is judged that the set time of the timer B2 has expired, at step S20, the reverse rotation of the paper feeding motor 106 is turned off.

Next, at step S21, it is judged whether the current rise indicating flag is set to "1". When it is judged YES, it is judged at step S22 whether the upper limit detecting sensor 101 is turned on. When the sensor 101 is turned on, in other words, when the upper surface of the paper has risen to reach its upper limit, a timer C is actuated at step S23. The timer C is used to turn off the forward rotation of the elevation motor 110 and operates so as to slightly increase the paper feeding pressure after correcting the no-paper feeding condition. Therefore, when at step S24, it is judged that the set time of the timer C has expired, at step S25, the current rise indicating flag is reset to "0", at step S26, the forward rotation of the elevation motor 110 is turned off, at step S27, the paper re-feeding flag is set to "1", and at step S28, the second-time flag is set to "1". By this operation, the paper loading plate 108 is raised higher than the ordinary elevation position according to the time preset by the timer C and the pressure, which presses the upper surface of the paper against the paper feeding roller 19 (paper feeding pressure), is set at a slightly higher value.

By the above-mentioned operation, the processing for correcting the no-paper feeding condition has been executed. After that, when this subroutine is executed, it is judged YES at step S2 and the paper feeding operation is restarted. Then, if the second-time paper feeding which has been restarted by this operation is also judged as a no-paper feeding condition (it is judged YES at step S10), it is judged NO at step S11 and the program proceeds to step S12 to execute the correcting process for actual paper jamming.

Furthermore, the automatic paper feeder may comprise various configurations other than the present embodiment. For example, when the no-paper feeding condition has occurred, the paper loading plate may be lowered and then raised to restart the paper feeding operation without rotating the paper feeding roller in the reverse direction. On the contrary, the paper feeding roller may be rotated in the reverse direction and then in the forward direction without lowering and raising the paper loading plate.

Although the present invention has described in connection with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. An automatic paper feeder that raises a paper loading plate in a paper cassette in order to press the upper surface of copying paper loaded on said paper loading plate against a paper feeding roller, for feeding the paper sheet by sheet in accordance with the rotation of said paper feeding roller, comprising:

means for raising and lowering said paper loading plate;

means for detecting the paper leaving the paper cassette, provided immediately downstream of said paper feeding roller;

controlling means for lowering said paper loading plate in order to release the pressure between the upper surface of the paper and said paper feeding roller when said paper detecting means does not detect the paper within a specified period of time after starting each paper feeding operation and then raising said paper loading plate in order to press the upper surface of the paper against said paper feeding roller to restart the paper feeding operation; and driving means for rotating said paper feeding roller in the forward and reverse directions, and wherein said controlling means rotates said paper feeding roller in the reverse direction when said paper detecting means does not detect the paper within a specified period of time after starting the paper feeding operation.

2. An automatic paper feeder as claimed in claim 1, wherein said controlling means raises said paper loading plate so that said paper loading plate is forced against said feeding roller with a greater force then it had while in the starting position.

3. An automatic paper feeder that presses a paper feeding roller against the upper surface of copying paper loaded in a paper cassette for feeding the paper sheet by sheet in accordance with the rotation of said paper feeding roller, comprising:

driving means for rotating said paper feeding roller in the forward and reverse directions;

means for detecting the paper leaving the paper cassette, provided immediately downstream of said paper feeding roller; and controlling means for rotating said paper feeding roller in the reverse direction when said paper detecting means does not detect the paper within a specified period of time after starting each paper feeding operation, and then rotating said paper feeding roller in the forward direction again by said driving means to restart the paper feeding operation.

4. An automatic paper feeder as claimed in claim 3, further comprising a paper loading plate provided in said paper cassette and means for raising and lowering said paper loading plate, and wherein said controlling means lowers said paper loading plate in order to release the pressure between the upper surface of the paper and said paper feeding roller when said paper detecting means does not detect the paper within a specified period of time after starting the paper feeding operation, and then raises said paper loading plate in order to press the upper surface of the paper against said paper feeding roller to restart the paper feeding operation.

5. An automatic paper feeder as claimed in claim 4, wherein said controlling means raises said paper loading plate so that said paper loading plate is forced against said feeding roller with a greater force then it had while in the starting position.

6. An automatic paper feeder that raises a paper loading plate in a paper cassette in order to press the upper surface of copying paper loaded on said paper loading plate against a paper feeding roller for feeding the paper sheet by sheet in accordance with the rotation of said paper feeding roller, comprising:

driving means for rotating said paper feeding roller in the forward and reverse directions;

means for raising and lowering said paper loading plate;

means for detecting the paper leaving the paper cassette, provided immediately downstream of said paper feeding roller; and controlling means for rotating said paper feeding roller in the reverse direction, and at the same time lowering said paper loading plate in order to release the pressure between the upper surface of the paper and said paper feeding roller when said paper detecting means does not detect the paper within a specified period time after starting each paper feeding operation, and then the same controlling means for raising said paper loading plate in order to press the upper surface of the paper against said paper feeding roller to restart the paper feeding operation.

7. An automatic paper feeder as claimed in claim 6, wherein said controlling means raises said paper loading plate to a position higher than a lowering operation starting position when said paper loading plate is lowered and then raised.

8. An automatic paper feeder for pressing the surface of copying loaded on a paper loading plate in a paper cassette against a paper feeding roller, for feeding the paper sheet by sheet in accordance with the rotation of said paper feeding roller, comprising:

means for altering the pressure between the upper surface of the paper and said paper feeding roller;

means for detecting paper sheets leaving the paper cassette, provided immediately downstream of said paper feeding roller;

driving means for rotating said paper feeding roller in the forward and reverse directions; and controlling means for increasing said pressure to restart a paper feeding operation when said paper detecting means does not detect the paper within a specified period of time after starting the paper feeding operation, wherein said controlling means rotates said paper feeding roller in the reverse direction, at the same time releases the pressure between the upper surface of the paper and said paper feeding roller when said paper detecting means does not detect the paper within a specified period of time after starting each paper starting operation, and then the same controlling means increases said pressure and rotates said paper feeding roller in the forward direction to restart the paper feeding operation.

* * * * *